US005918519A

United States Patent [19]

Schnabel et al.

[11] Patent Number: 5,918,519

[45] Date of Patent: Jul. 6, 1999

[54] APPARATUS FOR THE MANUFACTURE OF SHEETS OF CORRUGATED BOARD OF VARIABLE SIZE

[75] Inventors: Klaus Schnabel, Grafenwöhr; Karl Waldeck, Etzenricht; Edmund Bradatsch, Weiden, all of Germany

[73] Assignee: BHS Corrugated Maschinen- und Anlagenbau GmbH, Weiherhammer, Germany

[21] Appl. No.: 08/842,832

[22] Filed: Apr. 17, 1997

Related U.S. Application Data

[63] Continuation-in-part of application No. 08/503,425, Jul. 17, 1995, abandoned.

[30] Foreign Application Priority Data

Jul. 16, 1994 [DE] Germany ..... P 44 25 156
Jun. 7, 1995 [DE] Germany ..... 195 20 077

[51] Int. Cl.[6] ..... B26D 7/06

[52] U.S. Cl. ..... 83/428; 83/102; 83/425.4; 83/498; 83/508.2; 83/676

[58] Field of Search ..... 83/676, 428, 498, 83/499, 504, 425.4, 508.3, 508.2, 102

[56] References Cited

U.S. PATENT DOCUMENTS

| | | | |
|---|---|---|---|
| 3,274,956 | 9/1966 | Francia et al. | 83/676 |
| 3,651,723 | 3/1972 | Gallagher, Jr. et al. | 83/499 |
| 3,795,164 | 3/1974 | Schneider | 83/425.4 |
| 4,070,890 | 1/1978 | Stubbings | 83/425.4 |
| 4,567,796 | 2/1986 | Kloehn et al. | 83/428 |
| 4,934,234 | 6/1990 | Cavagna | 83/498 |
| 5,040,442 | 8/1991 | Nasu | 83/428 |
| 5,050,472 | 9/1991 | Potzsch | 83/428 |
| 5,099,732 | 3/1992 | Hashida et al. | 83/428 |
| 5,158,002 | 10/1992 | Matsunaga et al. | 83/498 |
| 5,393,294 | 2/1995 | Jobst | 493/342 |

FOREIGN PATENT DOCUMENTS 41 33 760 10/1991 Germany .

*Primary Examiner*—M. Rachuba
*Assistant Examiner*—Sean Pryor
*Attorney, Agent, or Firm*—Browdy and Neimark

[57] ABSTRACT

An apparatus for the manufacture of sheets of corrugated web of variable size comprises a margin cutting arrangement, which is disposed—in the conveying direction—downstream of, and separated from, longitudinal cutting arrangements and which is provided with cutting devices for cutting margins, which are permanently in engagement with the web of corrugated board. In the case of changes of format width accompanied by changes of the width of the margins to be cut off, this makes it possible that the latter can be cut continuously, which helps avoid malfunction.

27 Claims, 6 Drawing Sheets

APPARATUS FOR THE MANUFACTURE OF SHEETS OF CORRUGATED BOARD OF VARIABLE SIZE

This is a continuation-in-part of our application Ser. No. 08/503 425 filed Jul. 17, 1995, now abandoned without prejudice in favor of the present application.

BACKGROUND OF THE INVENTION

1. FIELD OF THE INVENTION

The invention relates to an apparatus for the manufacture of sheets of corrugated board of variable size, comprising at least one longitudinal cutting arrangement having longitudinal cutters adjustable at right angles to the conveying direction of the nondivided web of corrugated board for cutting sectional webs of corrugated board of differing format width, cutting devices adjustable at right angles to the conveying direction of the web of corrugated board for cutting lateral margins of the web of corrugated board, discharge devices for margins that have been cut off, and at least one cross cutting arrangement for cutting sheets of corrugated board from the nondivided sectional webs of corrugated board.

2. Background Art

In an apparatus of the generic type known from DE 41 33 760 A1, the at least one longitudinal cutting device is preceded by a cross cutting device for the margins. In the case of a change of size, i.e. in case the longitudinal cutting devices are adjusted to another format width of the sectional webs of corrugated board to be cut, then a cross cut is performed from both sides of the web. To this end, a corresponding cross cutting device is disposed upstream of the at least one longitudinal cutting device—referred to the conveying direction of the web of corrugated board. The two lateral cross cuts exceed the widest margin to be severed. There is no cross cutting of the complete web upstream of the longitudinal cutting devices. The web of corrugated board can be conveyed without cross cutting in the conveying direction as far as to the cross cutter for the the sheets of corrugated board, the guidance and accurate conveying motion thus being maintained. The cuts of transverse and longitudinal extension are performed precisely and with positional accuracy. The portion of the corrugated board web that has overlapping formats during the change of size is cut out as waste by the cross cutter located at the end of the apparatus and discarded. It is of disadvantage that the margins must be cross cut and led anew into the discharge devices for every change of size, which may cause malfunction, given the high conveying speeds of the web of corrugated board.

SUMMARY OF THE INVENTION

It is the object of the invention to embody an apparatus of the generic type such that the margins can be cut continuously, the apparatus not requiring cross cutting of the entire web of corrugated board to be performed for every change of size.

According to the invention, this object is attained in that the cutting devices for cutting the margins of the web of corrugated board are displaceable at right angles to the conveying direction of the web of corrugated board independently of the longitudinal cutters for cutting the sectional webs of corrugated board and in that they are permanently in engagement with the web of corrugated board at least during the change of format width. It is of crucial importance that the cutting devices for cutting the margins are adjustable independently of the longitudinal cutting arrangements for cutting different sizes, i.e. sectional webs of corrugated board of variable width, and that they are adjustable independently of these at right angles to the conveying direction. While the web of corrugated board is conveyed at full conveying speed, they are adjusted at right angles to the conveying direction, when margins of another width are to be cut due to a change of format width. This transverse displacement of the cutting devices takes place in the portion of change of format width, where possibly overlapping longitudinal cuts of the former size and of the new size are applied, i.e. in a portion that is waste anyway. Since the changes of width of the margins are comparatively small, this displacement can be performed over a very short portion of the web of corrugated board. Trouble free discharge of the margins is ensured, because they need not be led anew into the discharge device for every change of size. The cutting devices for cutting the margins, which are in permanent engagement with the web of corrugated board, may be conventionally rotating knives with counterknives, high-speed rotating single knives, laser or water-jet high-pressure cutting devices. In this regard, the detail of the cutting devices being permanently in engagement means that they permanently cut during operation, i.e. during the conveyance of the web of corrugated board.

In keeping with an object of the invention, the discharge devices for the margins are displaceable at right angles to the conveying direction of the web of corrugated board and one cutting device at a time for cutting a margin is coupled with a discharge device. Preferrably, one cutting device at a time for cutting a margin is mechanically coupled with a discharge device. This serves the purpose of improving trouble free discharge of the continuous margins.

In keeping with a further object of the invention, each cutting device has a knife disk driven in rotation and pivotable about a vertical pendulum axis, which ensures very rapid displacement of the cutting devices at right angles to the conveying direction of the web of corrugated board, in particular when the cutting devices have circular knife disks working without counterknives.

Further features, details and advantages of the invention will become apparent from the ensuing description of an exemplary embodiment, taken in conjunction with the drawing.

DESCRIPTION OF THE PREFERRED EMBODIMENT

Figure 1:
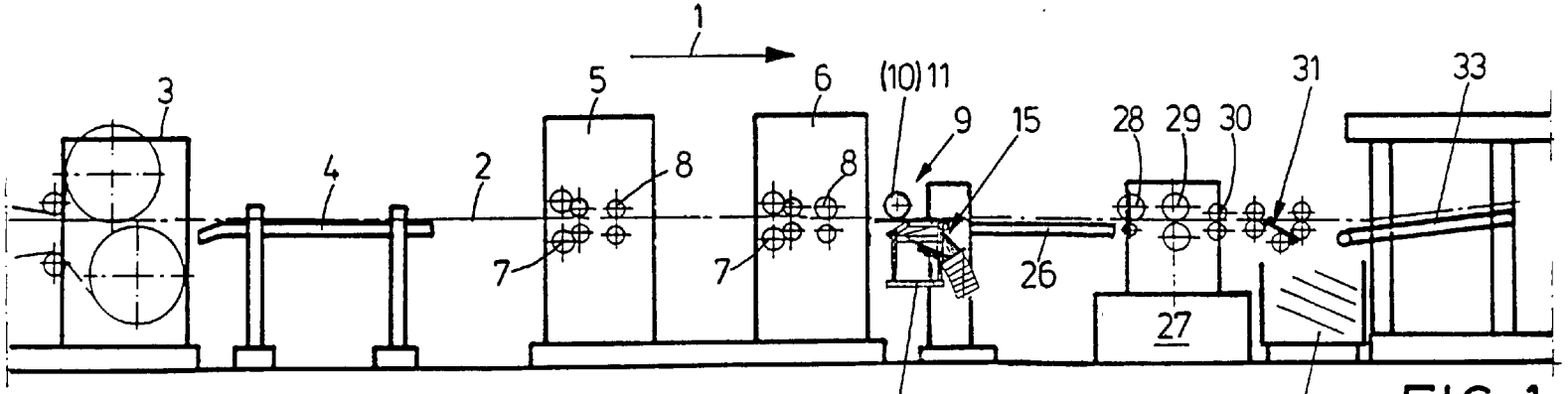
FIG. 1 is a diagrammatic illustration of a lateral view of an apparatus for the manufacture of sheets of corrugated board of variable size.
Figure 2:
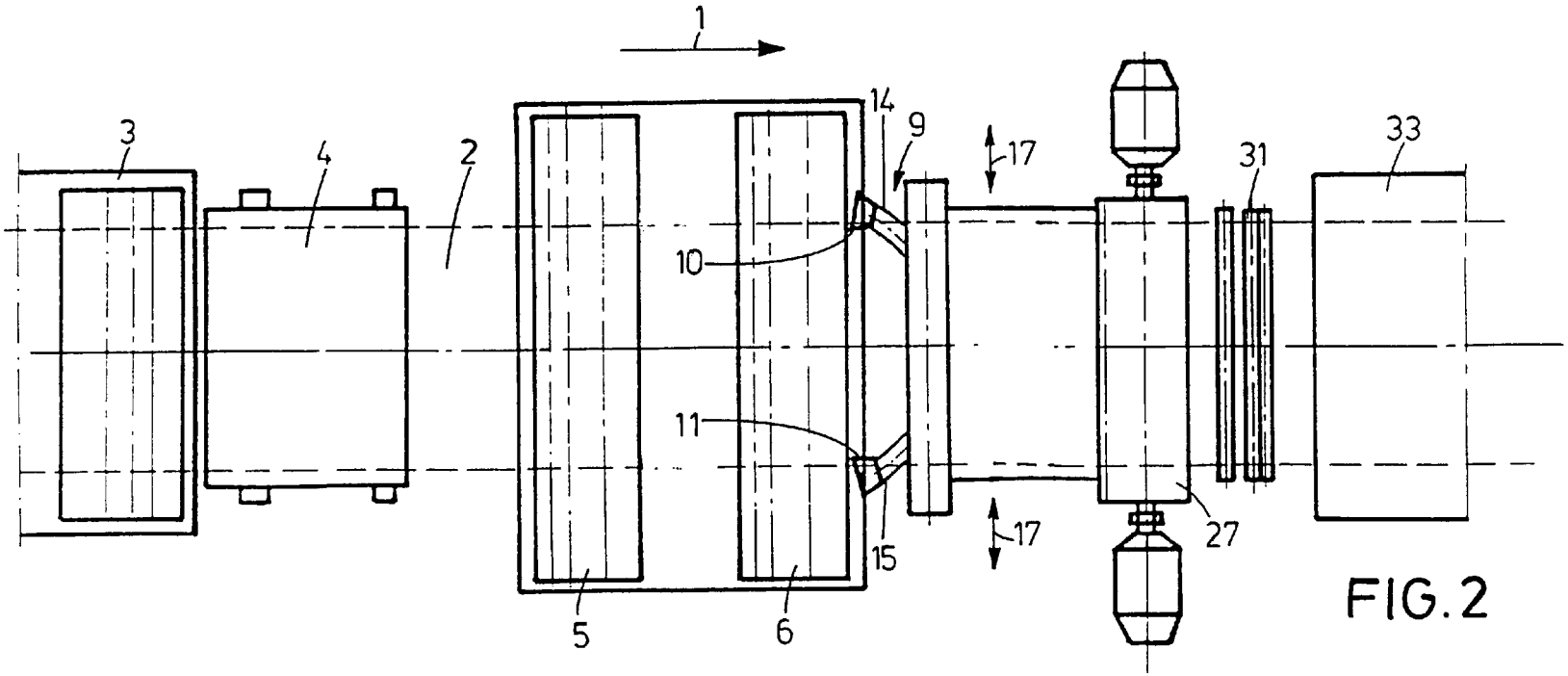
FIG. 2 is a plan view of the apparatus according to FIG. 1.

The apparatus of FIGS. 1 and 2 for the manufacture of sheets of corrugated board is described in the following, seen in the conveying direction 1 of a web 2 of corrugated board, i.e. from the left to the right in the drawing. The web 2 of corrugated board is supplied by means of a heating and feeding arrangement 3 and then guided over a short transfer table 4. Between the heating and feeding arrangement 3 and the transfer table 4, a cross cutter (not shown) can be disposed, which would serve only to cut out waste from the web 2 of corrugated board at the start of, or during, production. The transfer table 4 is followed by two longitudinal cutting arrangements 5, 6, which—referred to the conveying direction 1—are provided first with corrugating devices 7 followed by longitudinal cutters 8. The corrugating devices 7 and the longitudinal cutters 8 can be engaged with, or disengaged from, the web 2 of corrugated board, the corrugating devices 7 and longitudinal cutters 8 of only one longitudinal cutting arrangement 5 or 6 being in engagement with the web 2 of corrugated board during operation.

The longitudinal cutting arrangement 6 is followed by a margin cutting arrangement 9, which comprises two cutting devices 10, 11 for cutting lateral margins 12, 13 of the corrugated board web 2. A discharge device 14, 15 for such a lateral margin 12 or 13 that has been cut off is allocated to the cutting devices 10, 11. One cutting device 10 or 11 at a time is coupled with a discharge device 14 or 15, and that for instance on a common slide 16—as seen in FIG. 1. The cutting device 10 together with the discharge device 14 and the cutting device 11 together with the discharge device 15 are variable and adjustable at right angles to the conveying direction 1 and, horizontally, in the direction of advance 17 marked by a double-headed arrow.

Figure 3:
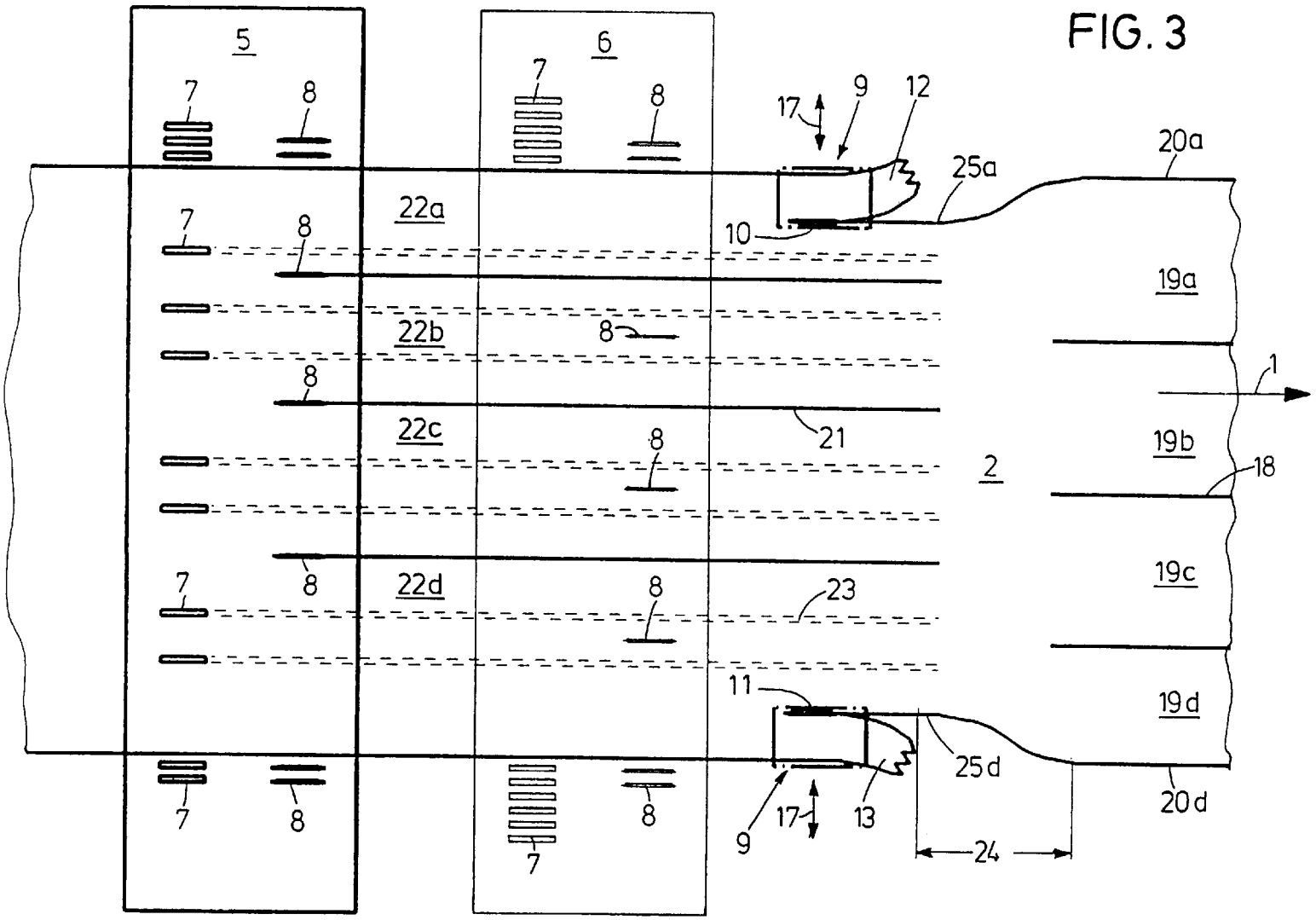
FIG. 3 is a plan view of a functional illustration of the change of width of the margins during a change of format.
Figure 4:
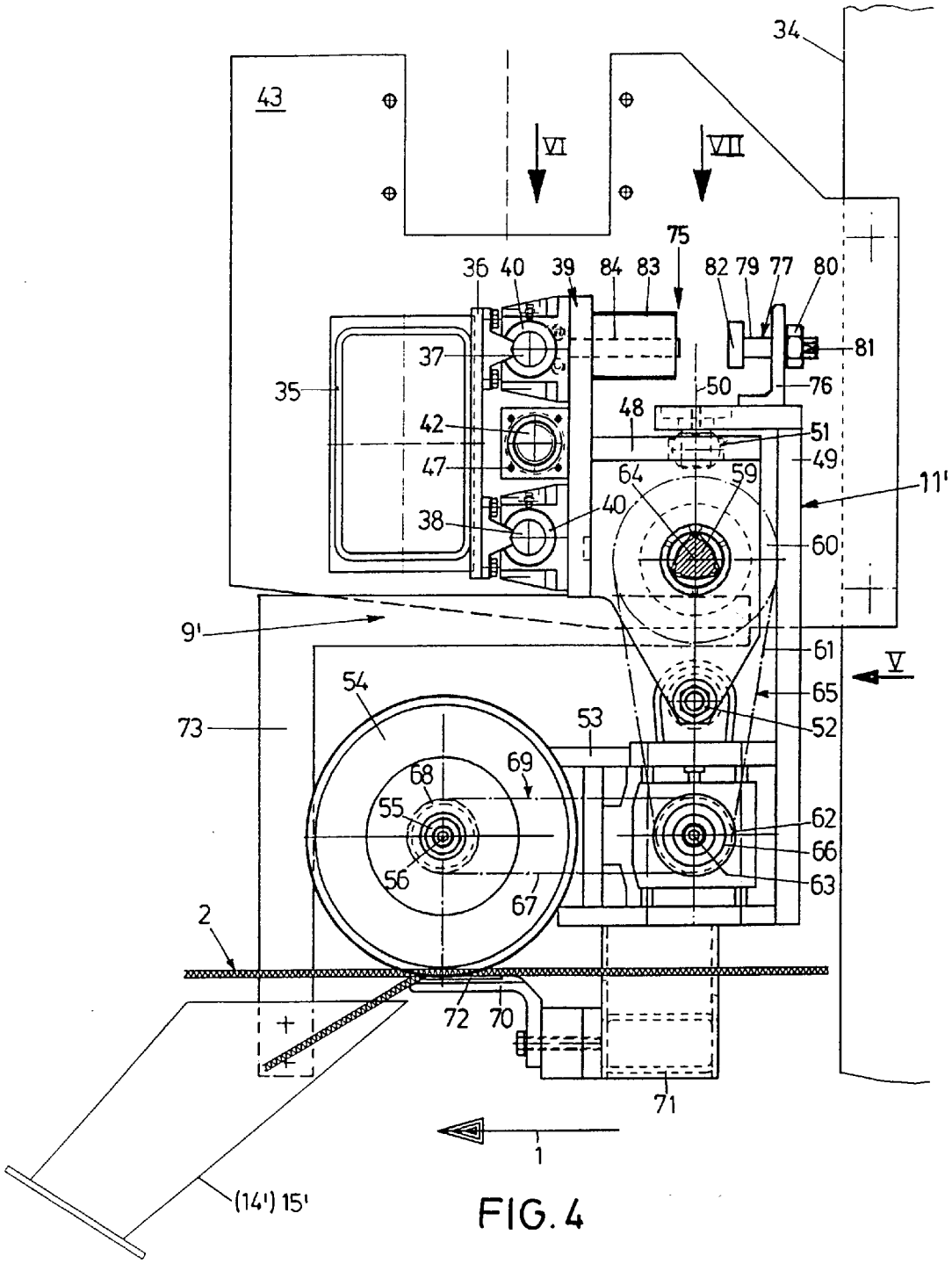
FIG. 4 is a vertical cross-section through a cutting device according to the section line IV—IV of FIG. 5.
Figure 5:
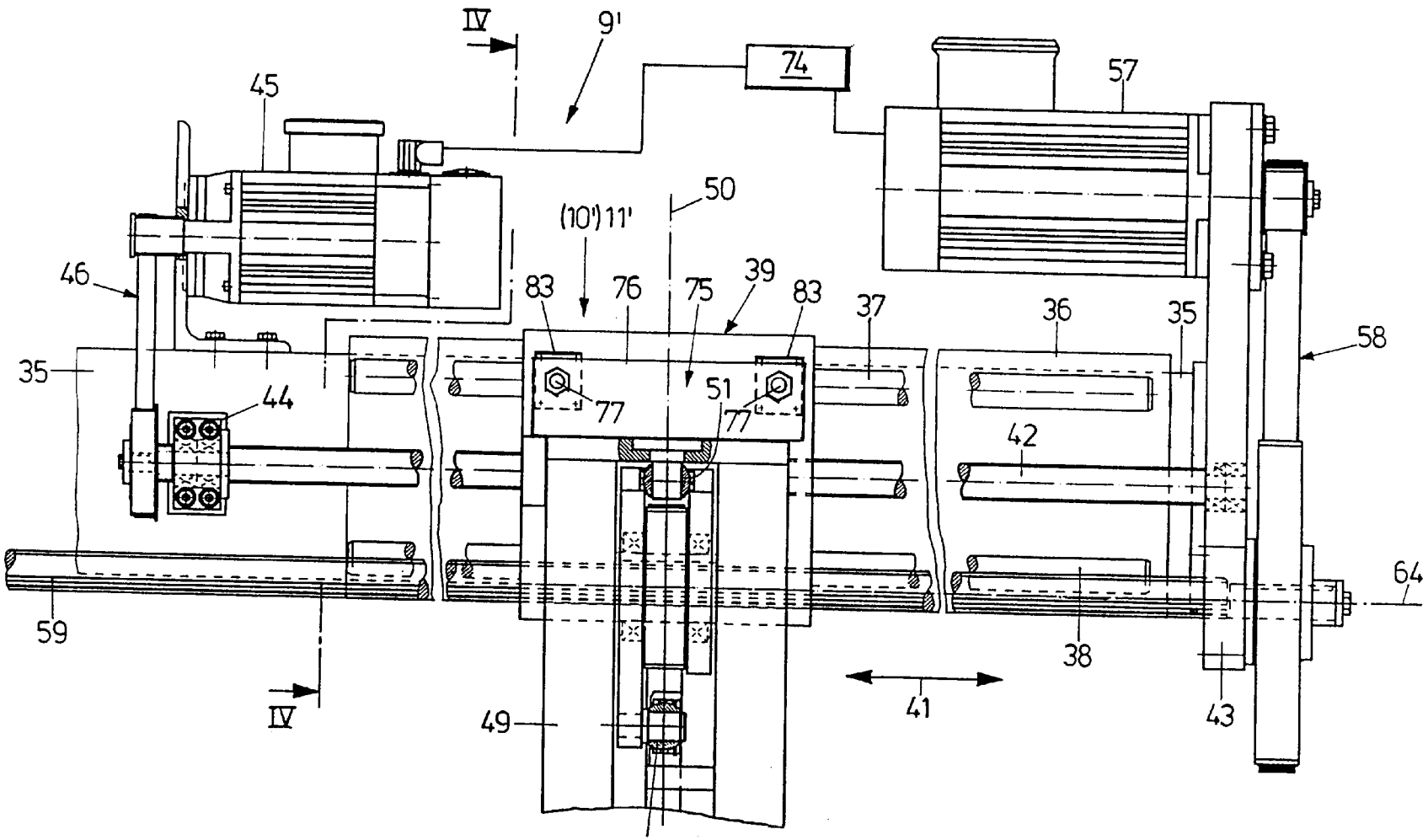
FIG. 5 is a view of the cutting device according to the arrow V of FIG. 4.

The functioning of the margin cutting arrangement 9 in cooperation with the longitudinal cutting arrangements 5, 6 is explained, taken in conjunction with FIG. 3. Of the two longitudinal cutting arrangements 5, 6, which can be combined to form a unit—as seen from FIGS. 1 and 2—use has so far been made of the backward longitudinal cutting arrangement 6—seen in the conveying direction 1. Its longitudinal cutters 8 have cut the corrugated board web 2 by longitudinal cuts 18 into four sectional webs 19*a*, 19*b*, 19*c* and 19*d* of corrugated board, the two outer sectional webs 19*a* and 19*d* being cut by means of the cutting devices 10, 11 of the margin cutting arrangement 9 such that they are provided with lateral edges 20*a* and 20*d*. For reasons of clarity, the illustration of FIG. 3 is chosen such that the corrugating devices 7 of the longitudinal cutting arrangement 6 have not been in engagement. In the case of the change of format width shown in FIG. 3, the longitudinal cutters 8 and the corrugating devices 7 of the longitudinal cutting arrangement 5 are adjusted to the new format widths already prior to the change of size. During the actual change of size—while the corrugated board web 2 continues to be conveyed—the longitudinal cutters 8 of the longitudinal cutting arrangement 6 are disengaged from the corrugated board web 2 so that they do not cut any longer. This is why the longitudinal cuts 18 are shown to move off to the right in FIG. 3. The longitudinal cutters 8, and in this case, also the corrugating devices 7 of the longitudinal cutting arrangement 5, are advanced toward the web 2 of corrugated board, i.e. they are moved into engagement with the latter, whereby longitudinal cuts 21 of a different position are produced in the web 2 of corrugated board, so that now sectional webs 22*a*, 22*b*, 22*c* and 22*d* of corrugated board of a format width other than before are cut. The sectional webs 22*a* to 22*d* are moreover provided with corrugations 23 extending in the conveying direction 1.

In the portion 24 of change of format width of the web 2 of corrugated board where the changeover takes place from the sectional webs 19*a* to 19*d*, to the sectional webs 22*a* to 22*d*, the cutting devices 10 and 11, which are permanently in engagement with the web 2 of corrugated board, are adjusted in the direction of advance 17, and along with them the discharge devices 14 and 15, without being disengaged from the web 2 of corrugated board during this adjustment. They are moved into a position in which they cut the lateral edges 25*a* and 25*d* of the two outer sectional webs 22*a* and 22*d* in the correct position. Since the adjustment of the cutting devices 10, 11 takes place during the engagement with the web 2 of corrugated board and during the latter's conveyance at full, i.e. normal, operating speed, the lateral margins 12, 13 are cut off permanently without interruption and taken by the discharge devices 14, 15, which may be conventional suction appliances. Since the discharge devices 14, 15 can be adjusted together with the cutting devices 10, 11, such an adjustment, i.e. a change of width of the lateral margins 12, 13, does not cause irregularities in their discharging operation. The portion 24 of change of format width of the web 2 of corrugated board or of the sectional webs 19*a* to 19*d* and 22*a* to 22*d* is subsequently cut out as waste. As seen in FIG. 3—the longitudinal cuts 18 or 21, respectively, can be arranged such that an integral portion of the corrugated board web 2, which is not divided longitudinally, remains between them; but they may also overlap each other.

The cutting devices 10 and 11 may be coupled to the discharge devices 14 and 15 electrically, instead of mechanically, for instance by sequence control drives. For reasons of clarity, the drives of the cutting devices 10 and 11 and of the longitudinal cutter 8 and the corrugating devices 7 are not shown.

Via a transfer table 26, the web 2 of corrugated board consisting of sectional webs is supplied to a so-called simplex cross cutter 27, which is provided with feed rollers 28, cutter rolls 29 and delivering rollers 30, all of them bearing in couples against the web 2 of corrugated board. The cutter rolls 29 are driven such that sheets of corrugated board of a given format length are cut, which is very often changed when the format width is changed. By means of this simplex cross cutter 27, sheets of corrugated board of identical format length are cut from all sectional webs 19*a* to 19*d* and then 22*a* to 22*d*. It is also in this cross cutter 27 where the portion 24 of change of format width is cut out of the web 2 of corrugated board and discarded via a subsequent sheet sluice 31 into a refuse tank 32. Other sheets of corrugated board found faulty will also be discarded via this sheet sluice 31 into the refuse tank 32.

This sheet sluice 31 is followed by a conventional sheet stacker 33, which delivers the sheets of corrugated board cut from the various sectional webs 19*a* to 19*d* and 22*a* to 22*d* of corrugated board to different sheet boxes.

The conveying speed of the web 2 of corrugated board remains unvaried as far as to the cross cutter 27, there being no cross cutting operation whatsoever nor even complete severing of the web 2 of corrugated board prior to, or during, the passage of the corrugated board web 2 through the longitudinal cutting arrangements 5, 6 or in the margin cutting arrangement 9.

FIGS. 4 to 7 illustrate an especially preferred embodiment of a margin cutting arrangement 9'. It comprises a frame 34 of a basic design as shown in FIGS. 1 and 2. This frame 34 is provided with an upper transverse beam 35 in the form of a box beam extending above the web 2 of corrugated board at right angles to the conveying direction 1. The lateral portions of this upper transverse beam 35 are provided with cutting devices 10', 11', of which only one cutting device 11' is shown in detail. Both cutting devices are structured and arranged mirror-symmetrically. The cutting device 11' shown in the drawing has a base plate 36, which is mounted on the upper transverse beam 35 and to which two guide rods 37, 38 extending horizontally, parallel to each other and one on top of the other in the vertical and at right angles to the conveying direction 1. On these guide rods 37, 38, a transverse slide 39 is displaceably guided by means of sliding bearings 40. The transverse slide 39 is displaceably driven in the specified direction of displacement 41 by means of a spindle 42, which rotatably lodged in a side wall 43 of the frame 34 on the one hand, and in a bearing 44 disposed on the upper transverse beam 35 on the other hand. It is driven by a displacing drive 45 in the form of an electric motor mounted on the upper transverse beam 35 and connected with the spindle 42 by means of a synchronous belt drive 46. The spindle 42 is guided in a spindle nut 47, which is disposed on the transverse slide 39. Rotations of the spindle 42 will result in displacements of the transverse slide 39 on the guide rods 37, 38 in the direction of displacement 41.

A supporting and bearing unit 48 is disposed on the transverse slide 39, a knife holder 49 being lodged and supported on this unit 48 to be pivotable about a vertical pendulum axis 50. To this end, the unit 48 is provided with an upper spherical bearing 51 and a lower spherical bearing 52, in which the knife holder 49 is lodged.

The lower end of the knife holder 49 located below the lower spherical bearing 51 is provided with a bracket 53 extending in the conveying direction 1. At the free end, positioned below the transverse slide 39, of this bracket 53, a circular knife disk 54 is rotatably lodged in a bearing 55. This knife disk 54 is driven about an axis of rotation 56 by means of a knife driving motor 57, which is mounted on the side wall 43 above the upper transverse beam 35. By way of a synchronous belt drive 58, the driving motor 57 drives a knife driving shaft 59, which extends over the entire width of the frame 34 and serves to drive both cutting devices 10', 11'. To this end, it is rotatably lodged in the side wall 43 and, correspondingly, in the opposite side wall (not shown) of the frame 34. A pinion 60 is disposed on the driving shaft 59 to be non-rotatable, but displaceable in the longitudinal direction of the driving shaft 59, this pinion 60 being disposed within the supporting and bearing unit 48—as seen in particular in FIG. 5. By means of a synchronous belt 61, this pinion 60 drives a gear 62, which is positioned around a horizontal axis of rotation 63 at the lower end of the knife holder 49 at the outset of the bracket 53 in the knife holder 49, the axis 63 extending parallel to the knife disk 54. The central axis 64 of the knife driving shaft 59 and the axis of rotation 63 intersect the pendulum axis 50. The latter is a vertical central axis for the pinion 60 as well as for the gear 62. The synchronous belt drive 65 constituted by the pinion 60, the synchronous belt 61 and the gear 62 lies in the pendulum axis 50.

Another pinion 66 is coupled with the gear 62 and, by way of a synchronous belt 67, drives a gear 68 connected with the knife disk 54. The pinion 66, the synchronous belt 67 and the gear 68 form a second synchronous belt drive 69.

A cutting table 70 extending horizontally and at right angles to the conveying direction 1 is disposed directly below the knife disk 54, the web 2 of corrugated board being guided over this cutting table 70. The latter is mounted on a lower transverse shackle 71 secured to the knife holder 49 outside the web 2 of corrugated board so that the cutting table 70, together with the knife holder 49, is pivoted about the pendulum axis 50.

Figure 6:
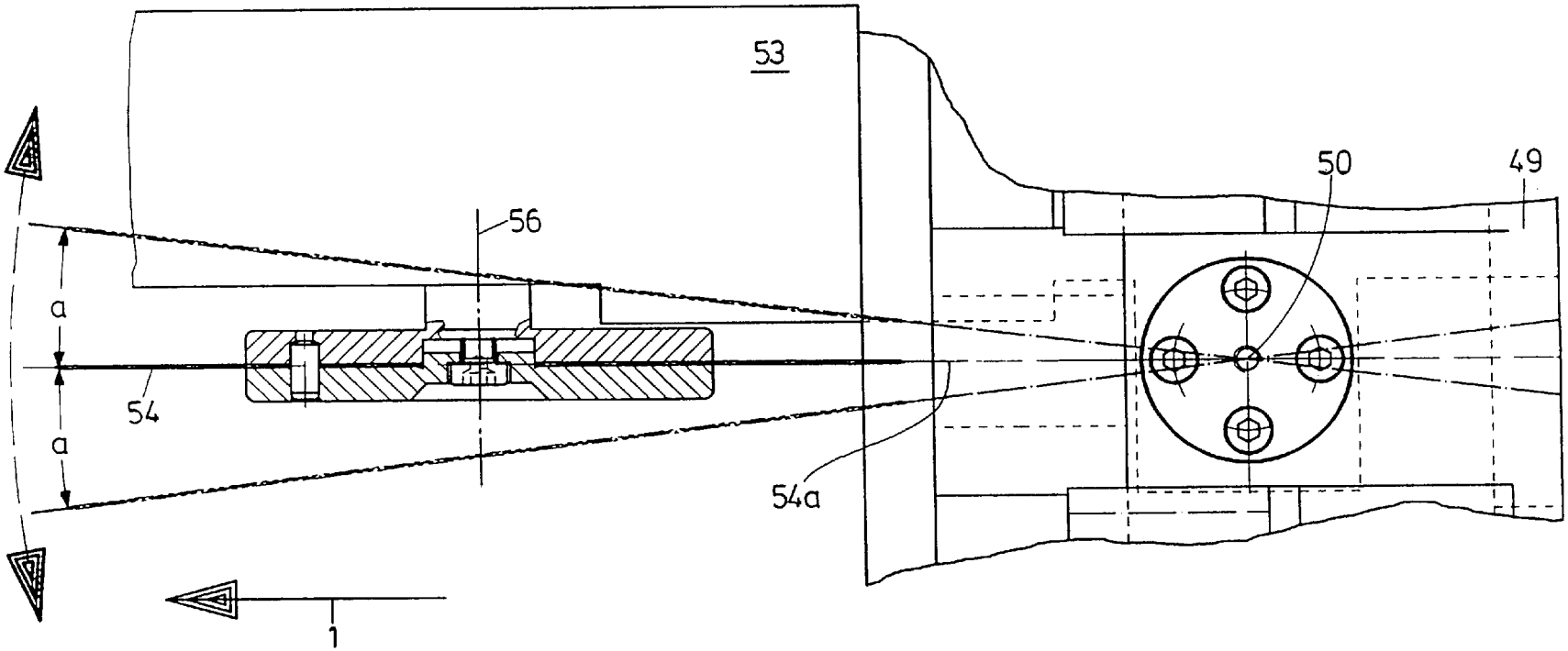
FIG. 6 is a highly schematic representation of a partial plan view of the cutting device according to the arrow VI of FIG. 4.
Figure 7:
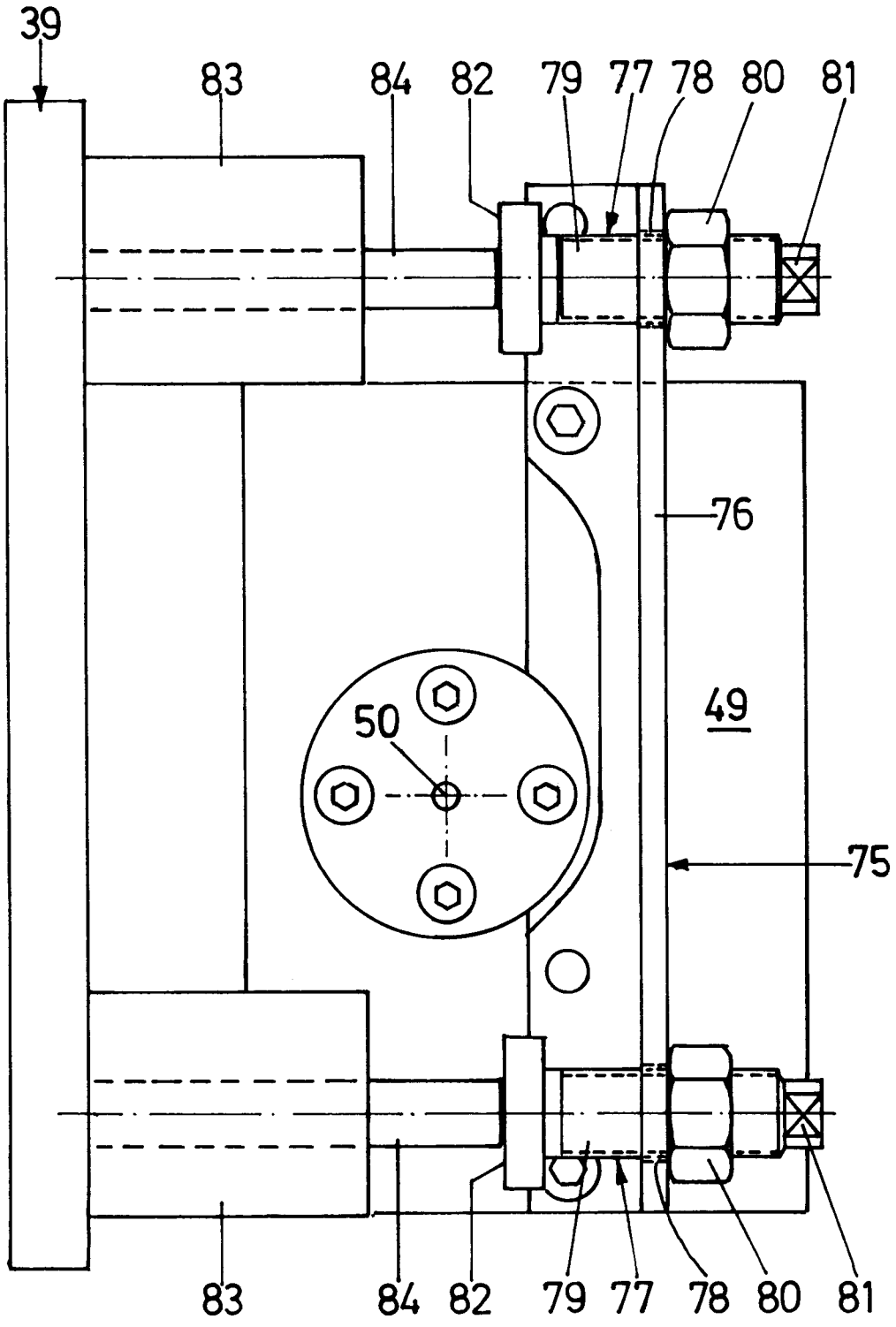
FIG. 7 is a partial plan view of the cutting device according to the arrow VII of FIG. 4.

As seen in FIG. 6, the knife disk 54 can be deflected about the pendulum axis 50 to both sides out of the conveying direction 1 by an angle a. The deflection of the gear 62 of the first synchronous belt drive 65 in relation to the latter's pinion 60 is accompanied by some minor deformation of the associated synchronous belt 61, which does not pose any problems, because the pendulum axis 50 is also the axis of symmetry of the first synchronous belt drive 65. Owing to the motion of the web 2 of corrugated board in the conveying direction 1, the knife disk 54 is moved exactly in the conveying direction 1. This is ensured in that the cutting level 54*a* of the knife disk 54 intersects the pendulum axis 50. In the case of a change of format width by the transverse slide 39 of each cutting device 10', 11' being driven in the direction of displacement 41, the pinion 60 is displaced on the knife driving shaft 59. Further, the knife holder 49 along with the knife disk 54 can swing about the pendulum axis 50 and be deflected from the conveying direction 1 by a range of swinging about the pendulum axis 50 defined by the angle a, particularly soft swinging from the lateral edges 20*a* or 20*d* to the lateral edges 25*a* or 25*d* thus being attained in accordance with the illustration of FIG. 3. As a result, the portion 24 of change of format width can become very short, i.e. the waste of corrugated board is very low.

For the knife disk 54 to cut completely through the web 2 of corrugated board, totally penetrating the latter, the cutting table 70 is provided with a slot 72 in association with the knife disk 54.

The margins 12, 13 cut off are discharged by discharge devices 14', 15', which are fixed to the supporting and bearing unit 48 and thus to the transverse slide 39 by means of a holder 73.

The control of the displacing drive 45 and of the knife driving motor is effected by a central control unit 74 of the apparatus.

Between the knifeholder 49 and the transverse slide 39, provision is made for an arresting device 75 of the following structure: An abutment 76 formed by an L profile is mounted on the knife holder 49 and extends approximately parallel to the transverse slide 39. Two stops 77 to be adjusted and regulated in the conveying direction 1 are mounted on this abutment 76—related to the direction of displacement 41—laterally of the pendulum axis 50. The stops 77 are threaded bolts 79, which are screwed into threaded holes 78 of the abutment 76 and which, on the side turned away from the transverse slide 39, are fixed by a nut 80 against the abutment 76 in a regulated position. They are adjustable by means of a polygon 81 formed on one end. On the other end turned toward the transverse slide, they have stop faces 82.

Allocated to the two stops 77, piston-cylinder units 83 are fixed on the transverse slide 39, their respective piston rod 84, upon corresponding pneumatic actuation, being displaceable against the allocated stop face 82 of the two stops 77. As a result, the knife holder 49 is interlocked with the transverse slide 39 in such a way that pivoting of the knife holder about the pendulum axis are precluded.

As described above, the knife disk 54 is pulled precisely in the conveying direction 1 because of the motion of the web 2 of corrugated board in the conveying direction 1. For this to be ensured, the cutting plane 54a of the knife disk runs through the pendulum axis 50. Pivoting the knife disk 54 into the conveying direction 1 takes place asymptotically, i.e. pivoting the knife disk 54 back from its deflection by the angle a will be comparatively slow at the very end of this back-pivoting motion, the restoring forces acting on the knife disk 54 tending to zero. At this time, the piston-cylinder units 83 are triggered via the control unit 74 so that the piston rods 84 are moved against the stop faces 82 in accordance with FIG. 7. In this way, the knife holder 49 comprising the knife disk 54 is adjusted into the central position and held in this position, in which the knife disk 54 extends precisely in the conveying direction 1.

It is of decisive importance that for any change of size including changes of width of the margins 12, 13 to be cut off, the knife disk 54 is set at an angle to the conveying direction 1, the range of deflection, i.e. the dimension of the angle a, depending on the speed of the web 2 of corrugated board in the conveying direction 1 on the one hand and on the speed of the transverse slide 39 in the direction of displacement 41 on the other hand. As a function of these variables, the deflection of the knife disk 54 by the angle a can be adjusted by means of a servomotor (not shown), which is triggered for instance by the control unit 74. In this regard, the pivoting of the knife disk 54 about the pendulum axis 50 need not forcibly be free pivoting; free pivotability however involves the advantage of especially low installation requirements.

What is claimed is:

1. An apparatus for the manufacture of sheets of corrugated board of variable size, comprising at least one longitudinal cutting arrangement (5, 6) having longitudinal cutters (8) adjustable at right angles to a conveying direction (1) of a nondivided web (2) of corrugated board for cutting said nondivided web (2) into nondivided sectional webs (19*a* to 19*d*; 22*a* to 22*d*) of corrugated board of differing format width, cutting devices (10, 11) adjustable at right angles to the conveying direction (1) of said web (2) of corrugated board for cutting lateral margins (12, 13) of said web (2) of corrugated board, discharge devices (14, 15) for margins (12, 13) that have been cut off, and at least one cross cutting arrangement (33) for cutting sheets of corrugated board from said nondivided sectional webs (19*a* to 19*d*; 22*a* to 22*d*) of corrugated board, wherein the cutting devices (10, 11; 10', 11') for cutting the margins (12, 13) of said web (2) of corrugated board are displaceable at right angles to the conveying direction (1) of said web (2) of corrugated board independently of the longitudinal cutters (8) for cutting said nondivided sectional webs (19*a* to 19*d*; 20*a* to 22*d*) of corrugated board and wherein means for cutting continuous margins (12, 13) before and after a chance of format width by holding said cutting devices (10, 11; 10', 11') permanently in engagement with said web (2) of corrugated board at least during said change of format width are provided.

2. An apparatus for the manufacture of sheets of corrugated board of variable size, comprising at least one longitudinal cutting arrangement (5, 6) having longitudinal cutters (8) adjustable at right angles to a conveying direction (1) of a nondivided web (2) of corrugated board for cutting said nondivided web (2) into nondivided sectional webs (19*a* to 19*d*; 22*a* to 22*d*) of corrugated board of differing format width, cutting devices (10, 11) adjustable at right angles to the conveying direction (1) of said web (2) of corrugated board for cutting lateral margins (12, 13) of said web (2) of corrugated board, discharge devices (14, 15) for margins (12, 13) that have been cut off, and at least one cross cutting arrangement (33) for cutting sheets of corrugated board from said nondivided sectional webs (19*a* to 19*d*; 22*a* to 22*d*) of corrugated board, wherein the cutting devices (10, 11; 10', 11') for cutting the margins (12, 13) of said web (2) of corrugated board are displaceable at right angles to the conveying direction (1) of said web (2) of corrugated board independently of the longitudinal cutters (8) for cutting said nondivided sectional webs (19*a* to 19*d*; 20*a* to 22*d*) of corrugated board, wherein means for cutting continuous margins (12, 13) before and after a change of format width by holding said cutting devices (10, 11; 10', 11') permanently in engagement with said web (2) of corrugated board at least during said change of format width are provided, and wherein the discharge devices (14, 15; 14', 15') for the margins (12, 13) are displaceable at right angles to the conveying direction (1) of the web (2) of corrugated board and wherein one cutting device (10, 11; 10', 11') at a time for cutting a margin (12, 13) is coupled with a discharge device (14, 15; 14', 15').

3. An apparatus according to claim 2, wherein one cutting device (10, 11; 10', 11') at a time for cutting a margin (12, 13) is mechanically coupled with a discharge device (14, 15; 14', 15').

4. An apparatus according to claim 1, wherein each cutting device (10', 11') has a knife disk (54) driven in rotation and pivotable about a vertical pendulum axis (50).

5. An apparatus according to claim 4, wherein the knife disk (54) is freely pivotable about the pendulum axis (50).

6. An apparatus according to claim 4, wherein—referred to the conveying direction (1) of the web (2) of corrugated board—the knife disk (54) is disposed downstream of the pendulum axis (50).

7. An apparatus according to claim 4, wherein each cutting device (10', 11') has a transverse slide (39), which is displaceable at right angles to the conveying direction (1) and on which the knife disk (54) is supported pivotably about the pendulum axis (50).

8. An apparatus according to claim 6, wherein the knife disk (54) is drivable by a belt drive (65), which comprises a pinion (60) being rotable but otherwise stationary relative to the transverse slide (39) and a gear (62), which is coupled with the pinion (60) via a belt (61) and which, together with the knife disk (54), is pivotable about the pendulum axis (50), the pendulum axis (50) being the central axis of the belt drive (65).

9. An apparatus according to claim 8, wherein the pinion (6) is non-rotatable relative to and displaceable along a knife driving shaft (59).

10. An apparatus according to claim 4, wherein the knife disk (54) has a cutting level (54*a*), which intersects the pendulum axis (50).

11. An apparatus according to claim 4, wherein means for arresting each cutting device (10', 11') in a position of the knife disk (54) in the conveying direction (1) are provided.

12. An apparatus according to claim 7, wherein an arresting device (75) is provided between each cutting device (10', 11') and the transverse slide (39).

13. An apparatus according to claim 12, wherein each arresting device (75) comprises at least a stop (77) and two a pneumatically actuated piston-cylinder unit (83) cooperating with the latter.

14. An apparatus according to claim 13, wherein each arresting device (75) comprises two stops (77) and two piston-cylinder units (83) disposed on both sides of the pendulum axis (50) at a distance from each other.

15. An apparatus according to claim 13, wherein the distance between the stop (77) and the piston-cylinder unit (83) is adjustable.

16. An apparatus according to claim 2, wherein each cutting device (10', 11') has a knife disk (54) driven in rotation and pivotable about a vertical pendulum axis (50).

17. An apparatus according to claim 16, wherein the knife disk (54) is freely pivotable about the pendulum axis (50).

18. an apparatus according to claim 16, wherein—referred to the conveying direction (1) of the web (2) of corrugated board—the knife disk (54) is disposed downstream of the pendulum axis (50).

19. An apparatus according to claim 16, wherein each cutting device (10', 11') has a transverse slide (30), which is displaceable at right angles to the direction (1) and on which the knife disk (54) is supported pivotably about the pendulum axis (50).

20. An apparatus according to claim 18, wherein the knife disk (54) is drivable by a belt drive (65), which comprises a pinion (60) stationary relative to the transverse slide (39) and a gear (62), which is coupled with the pinion (60) via a belt (61) and which, together with the knife disk (54), is pivotable about the pendulum axis (50), the pendulum axis (50) being the central axis of the belt drive (65).

21. An apparatus according to claim 20, wherein the pinion (60) is disposed non-rotatably, but displaceably on a knife driving shaft (59).

22. An apparatus according to claim 16, wherein the knife disk (54) has a cutting level (54*a*), which intersects the pendulum axis (50).

23. An apparatus according to claim 16, wherein said each cutting device (10', 11') is arrestable in a position of the knife disk (54) in the conveying direction (1).

24. An apparatus according to claim 19, wherein an arresting device (75) is provided between each cutting device (10', 11') and the transverse slide (39).

25. An apparatus according to claim 24, wherein each arresting device (75) comprises at least a stop (77) and a pneumatically actuated piston-cylinder unit (83) cooperating with the latter.

26. An apparatus according to claim 25, wherein each arresting device (75) comprises two stops (77) and piston-cylinder units (83) disposed on both sides of the pendulum axis (50) at a distance from each other.

27. An apparatus according to claim 25, wherein the distance between the stop (77) and the piston-cylinder unit (83) is adjustable.

* * * * *